United States Patent [19]

Childress

[11] 4,188,904

[45] Feb. 19, 1980

[54] TILLER MINDER

[76] Inventor: Jon P. Childress, 1742 Corcoran St., Washington, D.C. 20009

[21] Appl. No.: 878,877

[22] Filed: Feb. 17, 1978

[51] Int. Cl.[2] ..... B63H 25/10

[52] U.S. Cl. ..... 114/172; 74/495; 114/144 R

[58] Field of Search ..... 114/153, 162, 170, 172, 114/246, 253, 144 R; 74/480 B, 494, 495; 115/6.1, 18 R, 18 A; 224/29 E, 276

[56] References Cited

U.S. PATENT DOCUMENTS

| | | | |
|---|---|---|---|
| 2,027,517 | 1/1936 | Cobbs | 224/29 E X |
| 2,543,553 | 2/1951 | McAllister | 115/18 R X |
| 2,846,896 | 8/1958 | Allen | 114/172 X |
| 3,080,953 | 3/1963 | Edgemond, Jr. | 74/480 B X |
| 3,279,410 | 10/1966 | Young | 114/172 |
| 3,371,641 | 3/1968 | Rohman et al. | 115/18 R X |
| 3,838,660 | 10/1974 | Frisbee | 114/162 X |

*Primary Examiner*—Charles E. Frankfort
*Assistant Examiner*—Winston H. Douglas
*Attorney, Agent, or Firm*—Gilbert L. Wells

[57] ABSTRACT

An accessory for use on vessels, particularly sail boats, to maintain the tiller selectively in different positions. This accessory, or tiller minder, has an elongated portion connected at one end by a turnbuckle. The other end of the turnbuckle is articulated to a gunwale of the boat and the other end of the elongated portion is adjustably connected to the tiller.

8 Claims, 5 Drawing Figures

TILLER MINDER

CROSS REFERENCE TO A RELATED APPLICATION

Applicant has filed Disclosure Document No. 065944 on Nov. 15, 1977 and this disclosure is incorporated herein.

BACKGROUND OF THE INVENTION

The field of the invention is ships having rudder locks.

U.S. Pat. No. 3,279,410 shows the state of the art of tiller tenders for small boats and discloses an elongated rigid support mounted transverse to the length of the boat and having an open wound coil spring on the surface of the support. A detent secured to the tiller engages the open wound coil and holds the tiller in place.

Such tiller tenders or tiller minders permit the watch crew, the sailor with an inexperienced crew, or the single handed sailor to temporarily leave the helm to go forward or below decks. A well balanced boat, especially when it is reaching or beating to windward, will sail itself when the sails are properly set and the tiller is properly locked. When running downwind on long cruises the tiller tender or tiller minder is used to relieve the constant pressure on the helmsman.

Prior art tiller tenders such as disclosed in U.S. Pat. No. 3,279,410 have the limitation that they are held in place by gravity and the accessory must be removed completely or the tiller will be constantly locked when the tiller is dropped. This limitation is disadvantageous when it is necessary to throw the tiller hard over to come about or to avoid another vessel, as the tiller may lock in a hazardous position as it lowers.

SUMMARY OF THE INVENTION

Having in mind the limitations of the prior art it is an object of the present invention to provide a tiller minder which provides for instant disconnect of the tiller from the tiller minder in order to avoid collisions, knockdowns, or capsizing, and a device which will not inadvertently lock the tiller in a hazardous position.

This object is achieved in the present invention by a tiller minder comprising an accessory having a longitudinal portion adjustable in length by a turnbuckle. One end of the turnbuckle is articulated to the gunwale or vertical side of the cockpit of the boat and the other end of the longitudinal portion has a line of perforations or holes for mating with a vertical pin fastened to the tiller. The angle of the rudder is adjustable in two ways. In the first way the proper perforation in the longitudinal portion is selected for the pin on the tiller and the turnbuckle is then turned for the fine adjustment.

In another embodiment of the invention the accessory has two longitudinal portions adjustable to one another in length by a turnbuckle. The other end of one of the longitudinal portions is articulated to the gunwale or vertical side of the cockpit of the boat and the end of the second longitudinal portion has a line of perforations or holes.

BRIEF DESCRIPTION OF THE DRAWINGS

The invention is illustrated in the appended drawings, wherein.

DESCRIPTION OF THE PREFERRED EMBODIMENTS

Figures 1, 2, 3, 4:
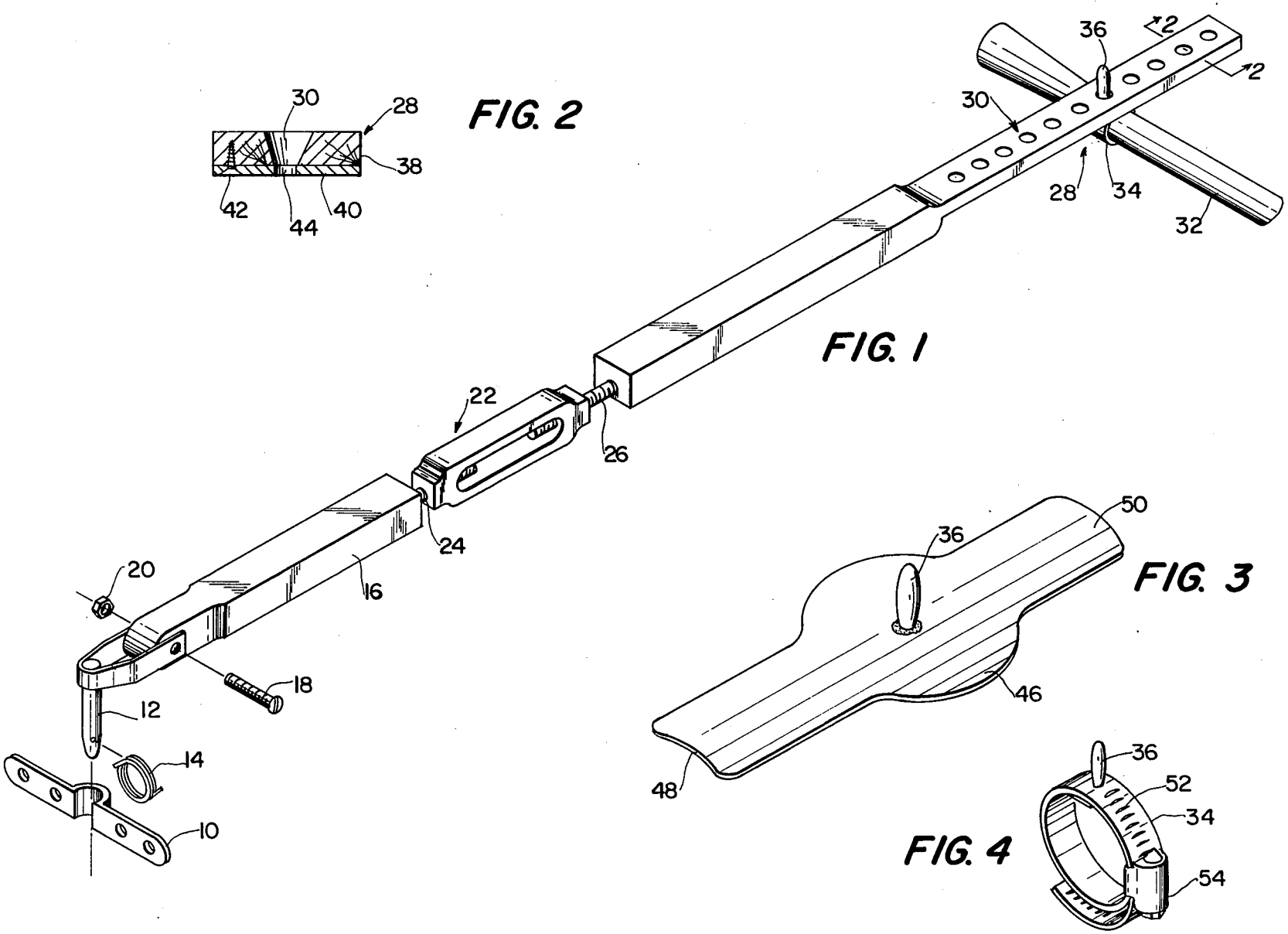
FIG. 1 is a perspective view of the tiller minder attached to a tiller with some portions exploded.
FIG. 2 is a sectional view along line 2—2 of FIG. 1.
FIG. 3 is a perspective view of a whip-on style tiller pin for attachment to the tiller by way of twine or tape.
FIG. 4 is a perspective view of a conventional band clamp having the tiller pin mounted on the top thereof.
Figure 5:
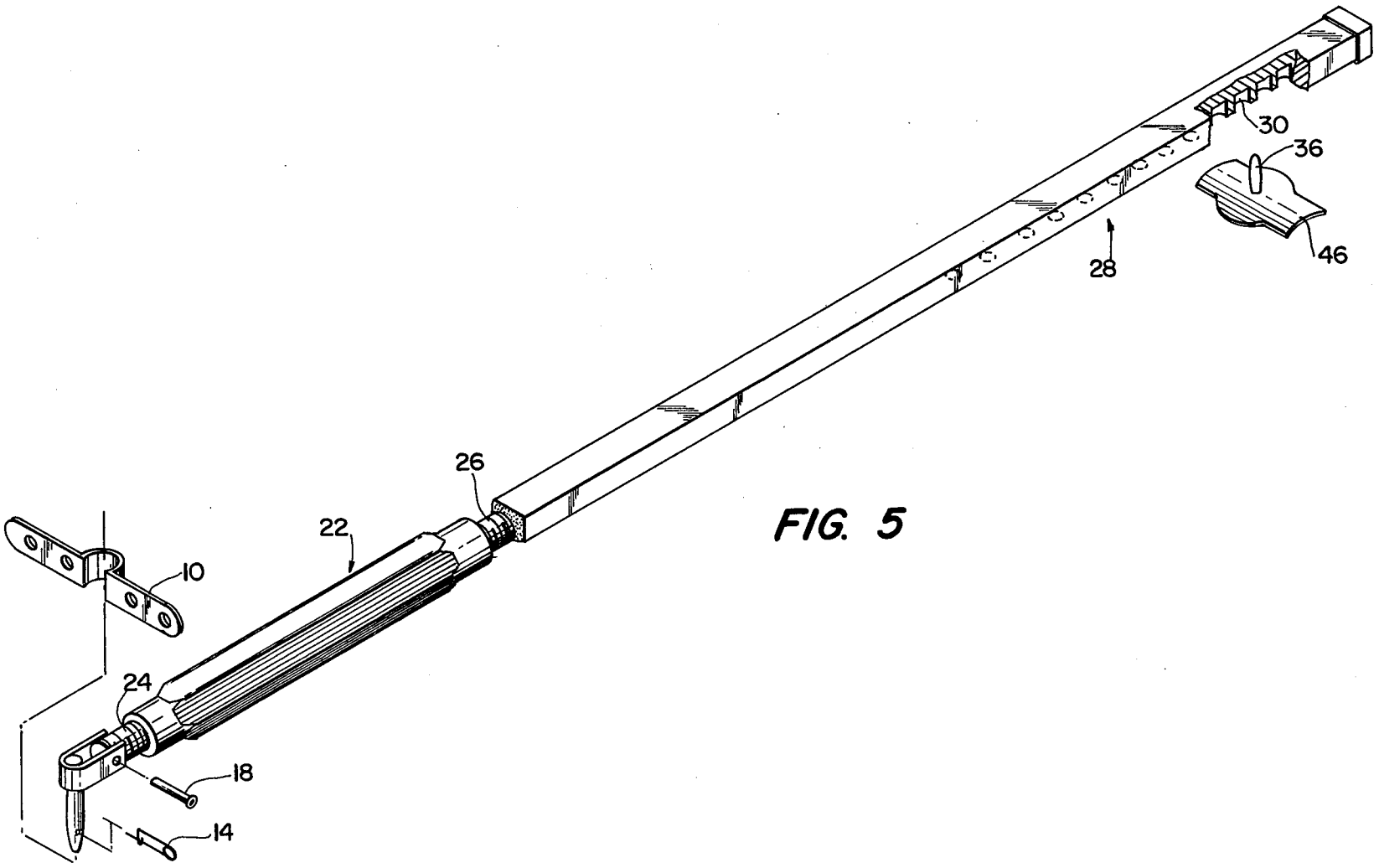
FIG. 5 is a perspective view of another embodiment of the tiller minder shown in FIG. 1 where one end of the turnbuckle is articulated directly with the gunwale.

The invention can be described with reference to FIG. 1. A stainless steel gudgeon 10 is secured to one side of one gunwale of a boat by screws or bolts through the holes provided therein. A pintle 12 is maintained with a rotation capability in the gudgeon by a keeper ring 14 fastened on the end of the pintle. The first longitudinal section 16 is fastened to the end of the pintle by bolt 18 and lock nut 20, or alternately a stainless steel rivet. The turnbuckle 22 has a right hand threaded screw 24 attached to the other end of the first longitudinal portion 16 and a left hand threaded screw 26 attached to the first end of a second longitudinal portion 28. The second longitudinal portion 28 has perforations or holes 30 which are shown in cross section in FIG. 2.

The tiller 32 has band clamp 34 mounted near the end thereof and the band clamp has a vertical pin 36 mounted on the top and articulated through the holes 30.

The second longitudinal portion is shown in cross section in a particular embodiment in FIG. 2. The hole 30 is conical in the wood portion 38 and metal capping plate 40 is affixed to the wood portion by screw 42. The metal capping plate 40 has holes concentric with the holes in wood portion 38 for retaining the pin 36, which is necessary in case the tiller must be locked in extreme off-center positions, as when applying weather helm when beating to windward.

Plate 46 for attaching the pin 36 to the tiller by means of twine or tape is shown in FIG. 3. The plate 46 is curved at ends 48 and 50 to conform to the curvature of the tiller. The pin 36 is suitably secured to a plate 46, such as 1/16" stainless steel by welding.

The band clamp 34 shown in FIG. 4 is a standard hose clamp having rows of slots 52 extending at an angle crosswise of one end and within which a worm screw 54 operates.

Of course the pin 36 can have a threaded portion on the bottom end so that it can be mounted in a hole drilled in the tiller and maintained in position by a nut and washer.

When the boat is in port the gudgeon 10 is maintained screwed to the gunwale and the pin 16 is left secured to the tiller. The remainder of the assembly is removed from the gudgeon by releasing keeper ring 14 and may be stored below decks or other storage area.

When the tiller minder is to be used, the pintle 12 is mounted on the gudgeon 10 and keeper ring 14 holds it in place so that the assembly is rotatable fore or aft in the boat.

After getting under way and it is desired to lock the tiller, the assembly is rotated over the pin 36 on the tiller and the appropriate hole 30 is placed thereover. Fine adjustments are made in the rudder angle by turning the turnbuckle 22.

In the case of an emergency, or a desire to change to manual operation, the assembly is lifted up off the pin 36 and manual operation is resumed. In this situation, the assembly may remain attached to the boat by gudgeon 10 and keeper ring 14, but articulated up and backward out of the cockpit area, and remain thus ready to be quickly re-attached to the tiller.

The longitudinal portions 16 and 28 may be constructed from wood, plastic or light metal. Typical plastics are polyethylene, polypropylene and nylon 6—6. Suitable gudgeons and pintles are conventional stainless stell rudder fittings. In the particular embodiment of FIG. 2, the second longitudinal portion 28 is fabricated from wood and steel. Of course it is possible to fabricate the entire assembly from stainless steel or plastic.

I claim:

1. A tiller minder for selectively locking a boat tiller in position so as to adjust the angle of the rudder comprising:

(a) a vertical pin mounted near the end of a tiller handle;

(b) articulating means mounted to one inside vertical surface of a boat;

(c) a longitudinal assembly having a first end connected to said articulating means and a second end secured over said vertical pin so as to allow said longitudinal assembly to be lifted up off said vertical pin for instant disconnection of said longitudinal assembly from said vertical pin, said articulating means allowing said longitudinal assembly to rotate fore or aft and up or down in the boat, said longitudinal assembly comprising first and second longitudinal portions connected by a turnbuckle, said turnbuckle adjusting the length of said longitudinal assembly; and (d) a plurality of holes aligned along said second longitudinal portion and extending vertically therethrough for mating with said vertical pin such that when it is desired to lock the tiller, said longitudinal assembly is rotated over said vertical pin whereby the appropriate hole is placed thereover with said turnbuckle providing for fine adjust of the rudder angle.

2. The tiller minder of claim 1, wherein said first and second longitudinal portions are wood.

3. The tiller minder of claim 2, wherein said second longitudinal portion has a metal plate under said wood.

4. The tiller minder of claim 1, wherein said first and second longitudinal portions are plastic.

5. A tiller minder for selectively locking a boat tiller in position so as to adjust the angle of the rudder comprising:

(a) a vertical pin mounted near the end of a tiller handle;

(b) articulating means mounted to one inside vertical surface of a boat;

(c) a longitudinal assembly including a turnbuckle and a longitudinal portion, said turnbuckle having a first end connected to said articulating means and a second end connected to said longitudinal portion, said turnbuckle adjusting the length of said longitudinal assembly, and said articulating means allowing said longitudinal assembly to rotate fore or aft and up or down in the boat; and (d) a plurality of holes aligned along said longitudinal portion and extending vertically thereinto for mating with said vertical pin such that when it is desired to lock the tiller, said longitudinal assembly is rotated over said vertical pin whereby the appropriate hole is placed thereover with said turnbuckle providing for fine adjustment of the rudder angle, and when it is desired to instantly disconnect said longitudinal assembly from said vertical pin, said longitudinal assembly is lifted up off said vertical pin.

6. The tiller minder of claim 5, wherein said articulating means is a gudgeon and pintle.

7. The tiller minder of claim 6, wherein said vertical pin is secured to said tiller by a band clamp.

8. The tiller minder of claim 6, wherein said vertical pin is mounted on a metal plate and said plate is secured to said tiller by wrappings.

* * * * *